US009732766B2

(12) United States Patent
Thompson et al.

(10) Patent No.: US 9,732,766 B2
(45) Date of Patent: Aug. 15, 2017

(54) ELECTRIC MOTOR-DRIVEN COMPRESSOR HAVING A HEAT SHIELD FORMING A WALL OF A DIFFUSER

(71) Applicant: Honeywell International Inc., Morristown, NJ (US)

(72) Inventors: Glenn F. Thompson, Palos Verdes Estates, CA (US); Mike Guidry, Redondo Beach, CA (US); John Mason, Torrance, CA (US); Rick Johnson, Torrance, CA (US); Patrick Beresewicz, La Mirada, CA (US)

(73) Assignee: Honeywell International Inc., Morris Plains, NJ (US)

( * ) Notice: Subject to any disclaimer, the term of this patent is extended or adjusted under 35 U.S.C. 154(b) by 330 days.

(21) Appl. No.: 14/226,309

(22) Filed: Mar. 26, 2014

(65) Prior Publication Data

US 2015/0275920 A1 Oct. 1, 2015

(51) Int. Cl.
*F04D 29/58* (2006.01)
*F04C 29/04* (2006.01)
(Continued)

(52) U.S. Cl.
CPC ..... *F04D 29/5846* (2013.01); *F04C 29/047* (2013.01); *F04D 17/12* (2013.01);
(Continued)

(58) Field of Classification Search
CPC ..... F04D 29/056; F04D 29/057; F04D 29/12; F04D 29/083; F04D 29/122;
(Continued)

(56) References Cited

U.S. PATENT DOCUMENTS 4,068,612 A 1/1978 Meiners
5,020,319 A 6/1991 Matsuura et al.
(Continued)

FOREIGN PATENT DOCUMENTS

EP 1479335 A2 11/2004
GB 2335710 A 9/1999
GB 2427248 A 12/2006

OTHER PUBLICATIONS

U.S. Appl. No. 14/184,122, filed Feb. 19, 2014, In re: Thompson et al., entitled *Sealing Arrangement for Fuel Cell Compressor*.
(Continued)

*Primary Examiner* — Charles Freay
*Assistant Examiner* — Kenneth J Hansen
(74) *Attorney, Agent, or Firm* — John C. James

(57) ABSTRACT

An electric motor-driven compressor includes a housing assembly comprising a motor housing and a compressor housing mounted thereto. The compressor housing contains a centrifugal compressor wheel that is mounted on a shaft of the motor rotor and also defines an air inlet that leads air into the compressor wheel, and a volute that collects the compressed air. Air bearings rotatably support the shaft. Cooling air passages are defined in the housing assembly for supplying cooling air to the air bearings. A diffuser between the exit of the compressor wheel and the volute serves to diffuse the compressed air. The compressor includes a heat shield formed separately from the compressor housing and the motor housing and disposed between them. The heat shield defines one wall of the diffuser and also cooperates with the housing assembly to define part of the cooling air passages for the cooling air supplied to the bearings.

6 Claims, 3 Drawing Sheets

(51) Int. Cl.
*F04D 17/12* (2006.01)
*F04D 25/06* (2006.01)
*F04D 29/056* (2006.01)

(52) U.S. Cl.
CPC ..... *F04D 25/06* (2013.01); *F04D 29/056* (2013.01); *F04D 29/5806* (2013.01); *F04D 29/5853* (2013.01)

(58) Field of Classification Search
CPC .... F04D 29/584; F04D 29/582; F04D 29/586; F04D 29/5846; F04D 17/12
See application file for complete search history.

(56) References Cited

U.S. PATENT DOCUMENTS 5,856,992 A * 1/1999 Karube ..... F04D 29/102 372/58
6,238,179 B1 * 5/2001 Wunderwald ..... F04D 29/162 415/110
6,422,838 B1 7/2002 Sloteman
2004/0005228 A1 * 1/2004 Agrawal ..... F04D 25/06 417/365
2004/0179947 A1 * 9/2004 Agrawal ..... F04D 17/12 417/212
2008/0273990 A1 11/2008 Pham et al.

OTHER PUBLICATIONS

U.S. Appl. No. 14/265,664, filed Apr. 30, 2014, In re: Thompson et al., entitled *Electric Motor-Driven Compressor Having an Electrical Terminal Block Assembly*.
U.S. Appl. No. 14/264,677, filed Apr. 29, 2014, In re: Thompson et al., entitled *Electric Motor-Driven Compressor Having B-Directional Liquid Coolant Passage*.
EPO Search and Opinion for Appl. No. EP 15158472.9, dated Sep. 24, 2015.

* cited by examiner

ELECTRIC MOTOR-DRIVEN COMPRESSOR HAVING A HEAT SHIELD FORMING A WALL OF A DIFFUSER

CROSS-REFERENCE TO RELATED APPLICATION

The present application is related to commonly owned, co-pending Application Ser. No. 14/184,122 filed on Feb. 19, 2014, the entire disclosure of which is hereby incorporated herein by reference.

BACKGROUND

The present disclosure relates to electric motor-driven compressors such as used for fuel cells.

Air compressors can be used to increase the efficiency of a fuel cell by providing compressed air to the cathode side of the fuel cell. A two-stage compressor may be used in some applications requiring a higher pressure than achievable in a single compressor stage. In a two-stage compressor, a low-pressure compressor wheel is provided on a shaft, and a high-pressure compressor wheel is provided on the same shaft. The shaft is driven by an electric motor so that the compressor wheels are rotated, and air enters the low-pressure compressor wheel and is compressed to a first pressure. The compressed air is then passed on to the high-pressure wheel for a further increase in pressure. The air from the high-pressure compressor wheel is then delivered to the fuel cell to promote the fuel cell reaction.

The electric motor used in a compressor for a fuel cell is typically a high-speed, high-output motor that generates a significant amount of heat. It is generally desirable to minimize the heat transfer between the motor and the air being compressed in the compressor, and the heat transfer between the motor and the bearings for the compressor shaft.

BRIEF SUMMARY OF THE DISCLOSURE

The present disclosure describes embodiments of electric motor-driven compressors such as useful with fuel cells or in other applications. In one embodiment, for example, an electric motor-driven compressor includes a housing assembly comprising a motor housing and a compressor housing mounted to the motor housing. The motor housing contains a motor stator and a motor rotor, and defines a bore through which a rotatable shaft passes. The compressor housing contains a centrifugal compressor wheel that is mounted on the shaft for rotation about the shaft axis. The compressor housing also defines an air inlet that leads air into the compressor wheel, and a volute that collects compressed air that has passed through the compressor wheel. A diffuser between the exit of the compressor wheel and the volute serves to diffuse the compressed air to a lower velocity and consequently a higher static pressure.

The electric motor-driven compressor in one embodiment includes air bearings that rotatably support the shaft. Cooling air passages are defined in the housing assembly for supplying cooling air to the air bearings.

In accordance with the present disclosure, the electric motor-driven compressor includes a heat shield that is formed separately from the compressor housing and the motor housing and is disposed between them. The heat shield defines one wall of the diffuser for the compressed air delivered into the volute. The heat shield also cooperates with the housing assembly to define part of the cooling air passages for the cooling air supplied to the air bearings.

In one embodiment, the motor housing defines a liquid coolant passage for circulating a liquid coolant, and the heat shield defines a mounting flange captured between the motor housing and the first compressor housing. The mounting flange is in contact with a portion of the motor housing cooled by the liquid coolant so as to facilitate heat transfer from the mounting flange to said portion of the motor housing.

In one embodiment, the heat shield and the motor housing are arranged so as to define an annular space therebetween for receiving cooling air, and the cooling air passages are arranged for receiving cooling air from the annular space. A cooling air gap additionally can be defined between the heat shield and the motor housing, the cooling air gap being arranged to receive cooling air from the annular space.

The compressor can also include a first seal carrier affixed to the shaft intermediate the first compressor wheel and the air bearings, and a first seal ring engaged in a circumferential groove formed about the first seal carrier. The first seal ring is positioned to seal against a radially inner surface of the heat shield so as to discourage air leakage between the first compressor flow path and the air bearings.

The features of the present invention can be applied to a two-stage serial compressor, such as the embodiment illustrated and described herein. In the case of such a two-stage compressor, a second compressor housing is mounted to an opposite end of the motor housing and a second centrifugal compressor wheel is contained in the second compressor housing and is affixed to an opposite end of the shaft. The second compressor housing defines a second compressor flow path including a second air inlet that leads air into the second compressor wheel, and a second volute that collects compressed air that has passed through and been compressed by the second compressor wheel. An interstage duct connects the second volute to the first air inlet such that air compressed by the second compressor wheel is led by the interstage duct from the second volute into the first air inlet and is further compressed by the first compressor wheel and delivered into the first volute. The second compressor wheel thus constitutes a low-pressure compressor wheel and the first compressor wheel constitutes a high-pressure compressor wheel.

In the two-stage compressor embodiment, the heat shield and the motor housing are arranged so as to define an annular space therebetween for receiving cooling air, and the cooling air passages are arranged for receiving cooling air from the annular space. The motor housing defines a cooling air inlet for supplying the cooling air that is received in the annular space. The housing assembly can define an annulus adjacent the low-pressure compressor wheel, the annulus receiving cooling air from the cooling air inlet, and the motor housing can define an axially extending conduit for feeding cooling air from said annulus into the annular space defined between the heat shield and the motor housing.

BRIEF DESCRIPTION OF THE SEVERAL VIEWS OF THE DRAWING(S)

Having thus described the present disclosure in general terms, reference will now be made to the accompanying drawings, which are not necessarily drawn to scale, and wherein:

DETAILED DESCRIPTION OF THE DRAWINGS

The present invention now will be described more fully hereinafter with reference to the accompanying drawings in which some but not all embodiments of the invention are shown. Indeed, aspects of the invention may be embodied in many different forms and should not be construed as limited to the embodiments set forth herein; rather, these embodiments are provided so that this disclosure will satisfy applicable legal requirements. Like numbers refer to like elements throughout.

Figure 1:
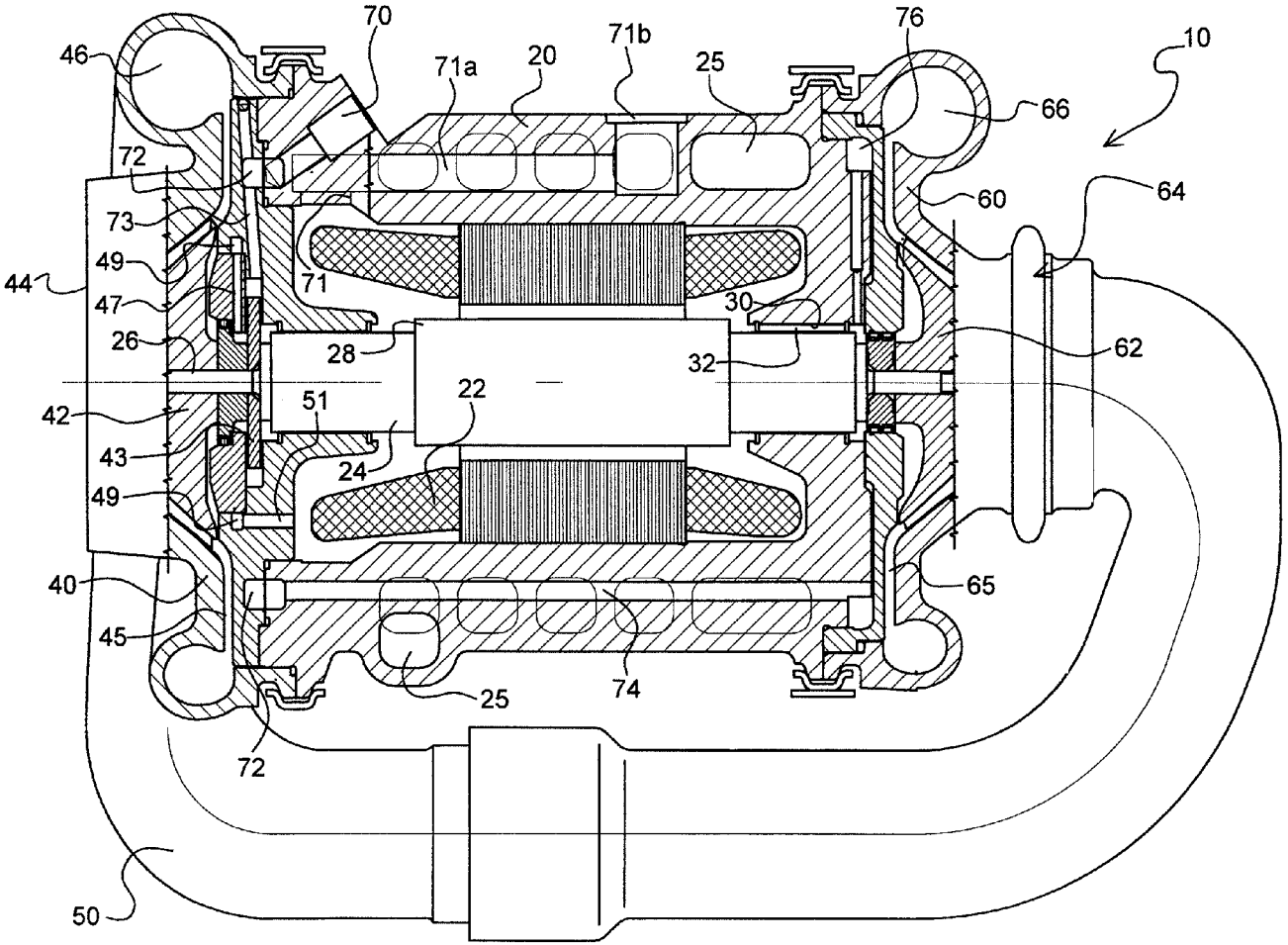
FIG. 1 is a side view, partly in section, of an electric motor-driven compressor in accordance with one embodiment of the invention, comprising a two-stage compressor having a low-pressure compressor and a high-pressure compressor in series.

The present invention may be applied in a variety of types of electric motor-driven compressors, including single-stage as well as multi-stage electric motor-driven compressors. The particular embodiment described herein for purposes of explaining the principles of the invention is a serial two-stage compressor having two centrifugal compressors arranged in series, but the invention is applicable to parallel two-stage compressors as well as other types. Thus, a simplified cross-sectional view of a serial two-stage electric motor-driven compressor 10 for use with a fuel cell (such as a proton exchange membrane (PEM) fuel cell) is shown in FIG. 1. The two-stage compressor 10 includes a housing assembly comprising a motor housing 20, a low-pressure compressor housing 40 mounted to one end of the motor housing, and a high-pressure compressor housing 60 mounted to the other end of the motor housing. The motor housing 20 contains a motor stator 22 and a motor rotor 24 having a shaft 26 about which permanent magnets 28 are fixedly mounted. The motor housing 20 defines a bore 30 through which the motor rotor 24 and the shaft 26 pass. Air bearings 32 are disposed in the motor housing 20 for rotatably supporting the rotor 24 and shaft 26.

The low-pressure compressor housing 40 contains a centrifugal low-pressure compressor wheel 42 that is mounted on one end of the shaft 26 for rotation therewith, the low-pressure compressor housing also defining a low-pressure compressor flow path including an air inlet 44 that leads air into the low-pressure compressor wheel, and a low-pressure volute 46 that collects compressed air that has passed through and been compressed by the low-pressure compressor wheel. The low-pressure compressor also includes a diffuser 45 that leads the compressed air from the low-pressure compressor wheel 42 into the low-pressure volute 46, and serves to reduce the velocity and increase the static pressure of the air going into the volute.

The high-pressure compressor housing 60 contains a centrifugal high-pressure compressor wheel 62 that is mounted on the opposite end of the shaft 26 for rotation therewith. The high-pressure compressor housing defines a high-pressure compressor flow path including an air inlet 64 that leads air into the high-pressure compressor wheel, and a high-pressure volute 66 that collects compressed air that has passed through and been compressed by the high-pressure compressor wheel. The high-pressure compressor also includes a diffuser 65 that leads the compressed air from the high-pressure compressor wheel 62 into the high-pressure volute 66, and serves to reduce the velocity and increase the static pressure of the air going into the volute.

The compressor further includes an interstage duct 50 that is connected between the low-pressure volute 46 and the inlet 64 to the high-pressure compressor for routing the compressed air from the low-pressure volute 46 to the high-pressure compressor for further pressurizing in a second-stage compression process.

Figure 2:
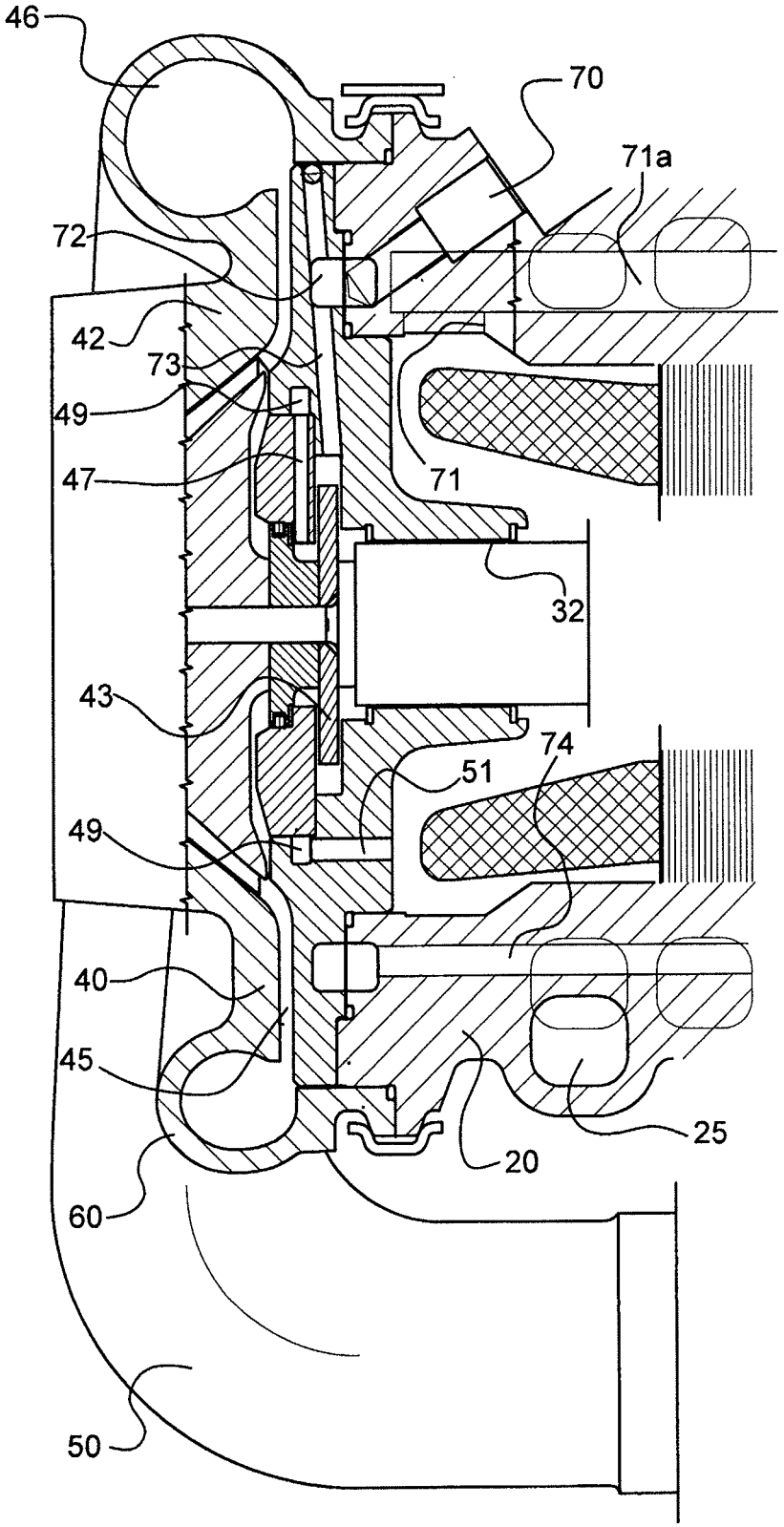
FIG. 2 is a magnified view of a portion of FIG. 1, showing details of how cooling air is supplied into an annular space between the heat shield and the motor housing.

Cooling air passages are defined in the housing assembly for supplying cooling air to the air bearings 32. In particular, with reference to FIG. 2, cooling air is supplied into a cooling air supply inlet 70 defined in the motor housing 20. For example, in the case of the compressor 10 being used in a fuel cell system for a vehicle, where the compressed air from the high-pressure volute 66 is passed through a vehicle heat exchanger to cool the air before it is supplied to the fuel cell, a portion of the air exiting the heat exchanger can be tapped off and supplied into the cooling air supply inlet 70. From there, the cooling air passes into an annulus 72 defined cooperatively by the motor housing 20 and low-pressure compressor housing 40. A portion of the cooling air in the annulus 72 is directed radially inwardly through passage 73 and is fed to both sides of a thrust plate 43 for the low-pressure side air thrust bearing. The air on the inboard (motor) side of the thrust plate 43 feeds the journal air bearing 32 (also cooling the rotor magnet 28) and is then discharged into the motor cavity. The air on the outboard side of the thrust plate 43 proceeds radially outwardly through passages 47 into an annular space 49 defined in the compressor housing, and from there it proceeds through a passage 51 into the motor cavity.

Figure 3:
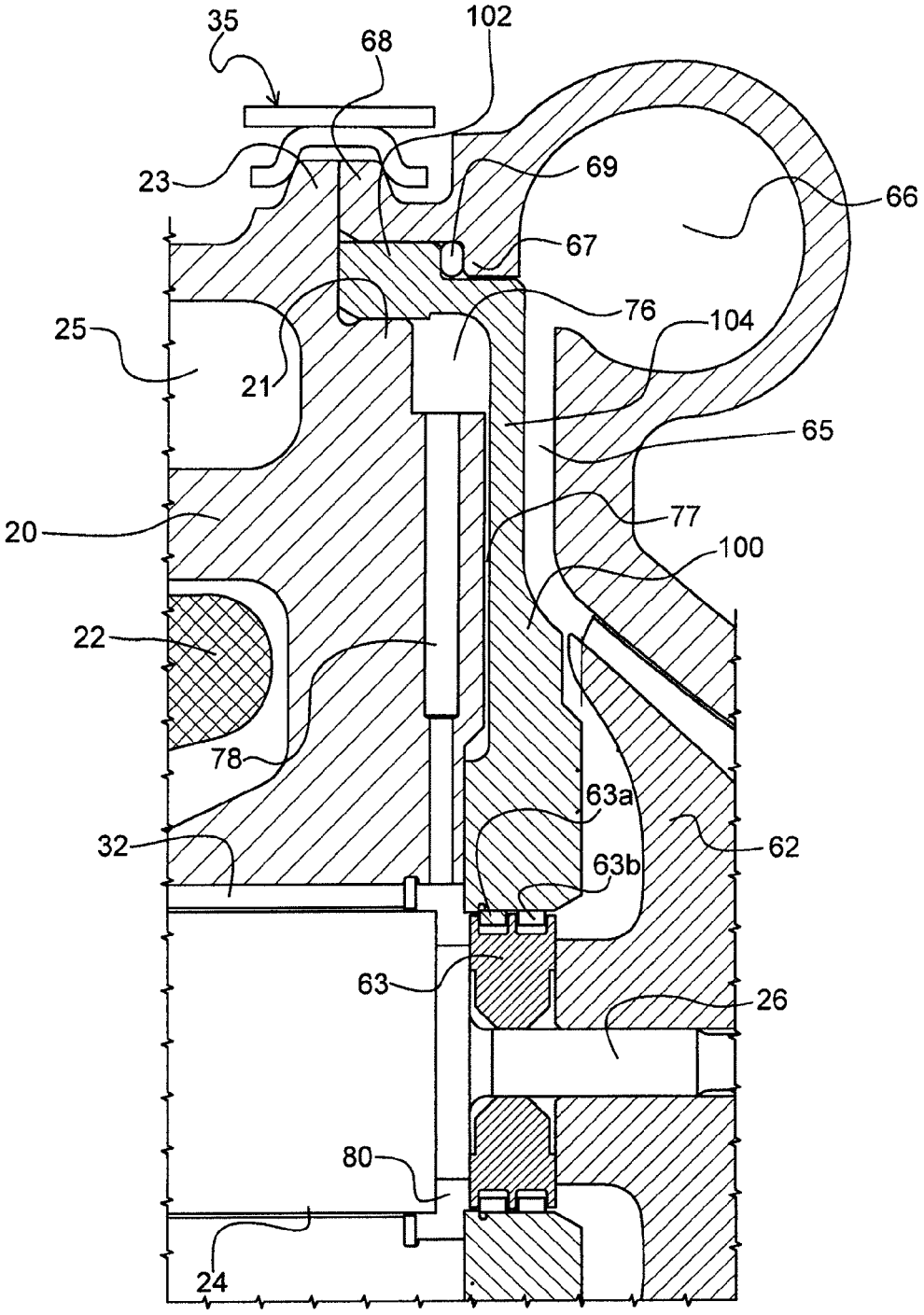
FIG. 3 is a magnified view of a portion of FIG. 1, showing details of the heat shield and its arrangement in the high-pressure compressor.

The remainder of the cooling air in the annulus 72 is directed through an axially extending cooling air conduit 74 that extends from the annulus 72 through the motor housing 20 and connects with a further annulus 76 (FIGS. 1 and 3) in the region of the high-pressure compressor. With reference to FIG. 3, the motor housing 20 defines cooling air passages 78 that lead from the annulus 76 generally radially inwardly into a generally annular space 80 at the high-pressure end of the motor rotor 24. Cooling air fed into the generally annular space 80 passes generally axially (to the left in FIG. 3) and feeds the journal air bearing 32 for the rotor 24 (also cooling the rotor magnet 28) and is then discharged into the motor cavity.

The cooling air in the motor cavity is evacuated from the motor cavity via a port 71, which is connected via a conduit 71*a* to a housing discharge port 71*b* (FIG. 1).

With reference now to FIG. 3, the high-pressure compressor includes a generally annular heat shield 100 that is formed separately from the high-pressure compressor housing 60 and the motor housing 20 and is disposed therebetween. In particular, the heat shield 100 has a flange 102 at its radially outer periphery, and the flange 102 is disposed, with respect to the radial direction, between a flange 68 of the compressor housing 60 and a shoulder 21 of the motor housing 20, and is sandwiched between the flange 68 and shoulder 21 so as to constrain the heat shield radially. The heat shield flange 102 is captured and constrained axially between a motor housing flange 23 and a shoulder 67 on the HP compressor housing 60. A V-band clamp 35 clamps together the motor housing flange 23 and HP compressor housing flange 68, and a sealing ring 69 disposed between the HP compressor housing shoulder 67 and the heat shield flange 102 is thereby axially compressed between these parts, thereby sealing the interface between the heat shield and the compressor housing. The heat shield 100 includes a radially directed wall portion 104 that extends radially inwardly from the flange 102 and defines one wall of the diffuser 65 for the compressed air delivered into the HP volute 66, an opposite wall of the diffuser being defined by the HP compressor housing 60.

With continued reference to FIG. 3, the previously described cooling air annulus 76 is defined cooperatively by the heat shield 100 and the motor housing 20. The cooling air passages 78 in the motor housing extend from the annulus 76 radially inwardly and feed the cooling air into the space 80 from which the air feeds the journal bearing as previously described. Thus, the heat shield 100 cooperates with the housing assembly to define part of the cooling air passages for the cooling air supplied to the air bearings.

The heat shield 100 also helps minimize heat transfer from the hot motor housing 20 to the air passing through the high-pressure compressor. To this end, the motor housing 20 makes little contact with the heat shield 100. The motor housing 20 defines a liquid coolant passage 25 for circulating a liquid coolant through the housing around the stator 22. The heat shield's mounting flange 102 captured between the motor housing 20 and the HP compressor housing 60 is in contact with a portion of the motor housing cooled by the liquid coolant in the liquid coolant passage 25 (note the close proximity of the flange 102 to the coolant passage 25 in FIG. 3) so as to facilitate heat transfer from the mounting flange to said portion of the motor housing. There is also an air gap 77 between the heat shield 100 and the motor housing 20. Air from the annulus 76 supercharges this dead-headed air gap 77. All of these features contribute toward the minimization of heat transfer from the motor housing, via the heat shield, to the air being compressed in the HP compressor.

The heat shield 100 additionally serves yet another function, namely, providing a sealing surface for the seals that substantially isolate the HP compressor discharge air from the HP journal bearing. Thus, the compressor includes a seal carrier 63 affixed about the shaft 26 at a location intermediate the HP compressor wheel 62 and the air journal bearing 32. A seal ring 63*a* is engaged in a circumferential groove formed about the seal carrier 63, and the seal ring is positioned to seal against a radially inner surface of the heat shield 100 (FIG. 3) so as to discourage air leakage from the HP compressor flow path into the journal air bearings. In the illustrated embodiment, there is also a second seal ring 63*b* in a second groove in the seal carrier 63 to further enhance the sealing.

While the invention has been described by reference to an electric motor-driven two-stage serial compressor, the invention may also be applied to other electric motor-driven compressors, such as a single-stage compressor. In the appended claims, references to a "first compressor wheel" are to be understood as applying either to the HP compressor wheel of a two-stage serial compressor (in which case the "second compressor wheel" is the LP compressor wheel), or to a compressor wheel in a single-stage compressor.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. An electric motor-driven compressor comprising:

a housing assembly comprising a motor housing and a first compressor housing mounted to one end of the motor housing, the motor housing containing a motor stator and a motor rotor having a shaft, the motor housing defining a bore through which the motor rotor and the shaft pass;

the first compressor housing containing a first centrifugal compressor wheel that is mounted on one end of the shaft for rotation therewith, the first compressor housing also defining a first compressor flow path including a first air inlet that leads air into the first compressor wheel, and a first volute that collects compressed air that has passed through and been compressed by the first compressor wheel;

a second compressor housing mounted to an opposite end of the motor housing and a second centrifugal compressor wheel contained in the second compressor housing and affixed to an opposite end of the shaft, the second compressor housing defining a second compressor flow path including a second air inlet that leads air into the second compressor wheel, and a second volute that collects compressed air that has passed through and been compressed by the second compressor wheel, and further comprising an interstage duct that connects the second volute to the first air inlet such that air compressed by the second compressor wheel is led by the interstage duct from the second volute into the first air inlet and is further compressed by the first compressor wheel and delivered into the first volute;

a first diffuser between an exit of the first compressor wheel and the first volute, the first diffuser serving to diffuse the compressed air to a lower velocity and deliver the compressed air into the first volute;

air bearings disposed in the motor housing and rotatably supporting the shaft;

cooling air passages defined in the housing assembly for supplying cooling air to the air bearings;

a heat shield that is formed separately from the first compressor housing and the motor housing and is disposed therebetween, the heat shield defining a mounting flange located at a radially outer periphery of the heat shield, and defining a shield portion that extends radially inwardly from the mounting flange and forms one wall of the first diffuser for the compressed air delivered into the first volute, the heat shield also cooperating with the housing assembly to define part of the cooling air passages for the cooling air supplied to the air bearings;

wherein the mounting flange of the heat shield is captured between a first compressor housing portion and a motor housing portion such that an annular space is bounded by the mounting flange at a radially outer side of the annular space and by the shield portion and the motor housing on opposite axial sides of the annular space, said annular space being located proximate the first volute for receiving cooling air;

wherein the motor housing defines a cooling air inlet that receives a portion of air from the second volute, and defines a passage that supplies part of said portion of air into the annular space proximate the first volute; and wherein the mounting flange of the heat shield engages the motor housing to space the shield portion of the heat shield axially away from a face of the motor housing so as to form a cooling air gap between the shield portion of the heat shield and said face of the motor housing, the cooling air gap being connected to the annular space and extending radially inwardly therefrom and being supercharged by cooling air from the annular space, and wherein a radially innermost part of the shield portion engages said face of the motor housing to close off the cooling air gap at a radially inner end thereof to make the cooling air gap deadheaded.

2. The electric motor-driven compressor of claim 1, wherein the motor housing defines a liquid coolant passage for circulating a liquid coolant, the mounting flange of the heat shield being in contact with the motor housing cooled by the liquid coolant so as to facilitate heat transfer from the mounting flange to of the motor housing.

3. The electric motor-driven compressor of claim 1, further comprising a first seal carrier affixed to the shaft intermediate the first compressor wheel and the air bearings, and a first seal ring engaged in a circumferential groove formed about the first seal carrier, and wherein the first seal ring is positioned to seal against a radially inner surface of the heat shield so as to discourage air leakage between the first compressor flow path and the air bearings.

4. The electric motor-driven compressor of claim 3, further comprising a second seal ring engaged in a second circumferential groove formed about the first seal carrier and positioned to seal against the radially inner surface of the heat shield.

5. The electric motor-driven compressor of claim 1, wherein the cooling air passages are arranged for receiving cooling air from the annular space.

6. The electric motor-driven compressor of claim 1, wherein the housing assembly defines an annulus adjacent the second compressor wheel, the annulus receiving cooling air from the cooling air inlet, and wherein said passage defined in the motor housing-comprises an axially extending conduit for feeding cooling air from said annulus into the annular space defined between the heat shield and the motor housing.

* * * * *